US006015221A

United States Patent [19]

Bodell

[11] Patent Number: 6,015,221

[45] Date of Patent: Jan. 18, 2000

[54] ARRANGEMENT FOR THE ATTACHMENT OF A LAMPHEAD TO A PANEL

[75] Inventor: Steven W. Bodell, Troutville, Va.

[73] Assignee: Hubbell Incorporated, Orange, Conn.

[21] Appl. No.: 09/053,899

[22] Filed: Apr. 2, 1998

[51] Int. Cl.[7] ..... F21V 21/28

[52] U.S. Cl. ..... 362/427; 362/371; 362/410; 362/370

[58] Field of Search ..... 362/371, 368, 362/370, 362, 410, 413, 414

[56] References Cited

U.S. PATENT DOCUMENTS 4,092,528 5/1978 Puyplat ..... 362/427
4,372,718 2/1983 Zaydel .
5,504,665 4/1996 Osteen et al. ..... 362/371
5,632,553 5/1997 Huang .

*Primary Examiner*—Sandra O'Shea
*Assistant Examiner*—Anabel Ton
*Attorney, Agent, or Firm*—Jerry M. Presson; Leopold Presser

[57] ABSTRACT

An arrangement for assembling a lamphead and a panel and securing them together to allow for full adjustability in the rotationally adjusted positioning of the lamphead relative to the panel through the utilization of a minimum amount of fastener elements and without the necessity for having to remove any panels or fasteners. A disk element has a center hole with a radially inwardly extending protuberance or key, and with a plurality of closely spaced small holes or apertures formed in the disk and annularly arranged about the center keyed hole in a predetermined circular pattern.

12 Claims, 4 Drawing Sheets

ARRANGEMENT FOR THE ATTACHMENT OF A LAMPHEAD TO A PANEL

BACKGROUND OF THE INVENTION

1. Field of the Invention

The present invention relates to an arrangement for securing a lamphead to a panel. More particularly, the arrangement for assembling the lamphead and the panel and securing them together is adapted to allow for full adjustability in the positioning of the lamphead relative to the panel through the utilization of a minimum amount of fastener elements and without the necessity for having to remove any panels or fasteners.

Ordinarily, lampheads may include connecting elements, such as essentially hollow posts or the like through which there are passed electrical wiring. The posts may possess external screwthreaded portions at the ends distant from the lampheads forming stub shafts which are adapted to extend through holes or apertures formed in panels or other types of plate structure, such as that of a fixture. A fastener element, such as a lock or threaded nut or the like is adapted to be screwed onto the screwthreaded stub shaft portion of the post from the side of the panel aperture through which it protrudes so as to as to be positionable into close proximity or engagement with the opposite surface of the plate or panel, and to thereby clampingly attach the lamphead to the panel or plate. In a specific instance, the aperture in the plate or panel may be polygonal in shape; for example square, and adapted to be engaged by a correspondingly shaped member mounted on the post. This enables rotational adjustment of the lamphead, but only at large angular increments; i.e. 90°, in dependence upon the number of sides of the polygonal configuration. This presently employed method of attaching a lamphead to a plate or panel, i.e. a fixture, does not readily facilitate or enable the precise and finely-incremental rotational orientation of the lamphead relative to the panel or fixture, such rotational positioning being implemented primarily by means of visually effected trial and error, and as a consequence, frequently resulting in the rotational position of the lamphead being offset from its intended orientation.

Another type of arrangement presently employed in the attaching of a lamphead to a panel or plate structure, such as a fixture, utilizes a spring clip which is fitted into a peripheral groove cut into the stub shaft portion of the post, the latter of which extends directly through the plate to below the opposite surface of the panel or plate so that the groove is located adjacently thereto. Thus, upon the spring clip being inserted into the groove, although this allows for easy rotational manipulation and adjustment of the lamphead relative to the plate or panel, the spring clip may at times be cocked out of the groove, thereby preventing a smooth installation, and thereby also conceivably inhibiting the precise rotationally latched orientation of the lamphead relative to the position of the panel.

2. Discussion of the Prior Art

Although various lamphead attachments as set forth hereinabove are known in the technology, none of these provide for the finely indexed rotational adjustment of a lamphead relative to a panel structure.

With regard to Huang, U.S. Pat. No. 5,632,553, this disclosure describes a free-standing lamp having a modular connection, and in which a lamphead is adapted to be attached atop the upper end of an upstanding base column. There is no provision for rotationally adjusting in close angular increments, the upper end of a lamphead structure relative to an upstanding column end and a base analogous to that provided for by the present invention.

Zaydel, U.S. Pat. No. 4,372,718, describes a tail lamp attachment, wherein a tail lamp assembly may be attached to a vehicle body panel, and wherein a plurality of square projections on the lamp are adapted to pass through similarly contoured apertures formed in a bumper or fender of the automobile or vehicle. There is no provision for rotational adjustment of a lamphead relative to a panel analogous to the inventive concept.

SUMMARY OF THE INVENTION

In order to inventively improve upon the foregoing in devising a lamphead and related supportive structural components which facilitate the lamphead to be attached to or mounted on a plate or disk in a precise rotational orientation relative thereto, there is provided a disk element having a center hole having a radially inwardly extending protuberance or key, and with a plurality of closely spaced small holes or apertures formed in the disk and annularly arranged about the center keyed hole in a predetermined circular pattern. The structural components include a post to the upper end of which there is attached a swivel for mounting a lamphead. The lower portion of the post includes a hexagonal nut forming a stop which is adapted to be positioned on the upper surface of the plate or panel, while extending downwardly therefrom is an externally screwthreaded stub shaft having an axial groove forming a keyway. This stub shaft is passed through the hole in the panel until the stop contacts the panel surface and the disk is slid onto the stub shaft such that the key in the hole thereof engages into the keyway of the stub shaft thereby securing the disk and the threaded stub shaft of the post for the lamphead swivel element in a condition inhibiting rotational movement therebetween.

The bottom surface of the panel is provided with one or more raised dimples, preferably hemispherically-shaped protuberances, which are spaced in a circular pattern or oppositely located about the central axis of the hole through which the shaft is passed, and which are in radial alignment with the circumferentially spaced apertures in the disk so that upon the bottom end of the stub shaft having been extended through the hole of the disk and which the screwthreaded portion of the shaft engaged by a lock nut having an internal screw thread, the circumferentially spaced holes of the disk are interengaged with the raised dimple or dimples on the plate bottom surface which are in alignment therewith, thereby locking the lamphead in secured position against rotation relative to the plate or panel. When it is desired to rotationally adjust the lamphead relative to the panel, it is merely necessary to rotate the post having the threaded stub shaft and the disk which is keyed thereto through a predetermined angular or rotational displacement, so as to have another one or more of the circularly spaced apertures of the disk engaging the raised dimple or dimples.

Accordingly, it is an object of the present invention to provide an arrangement for securing a lamphead to a panel in a predetermined angularly or rotationally adjustable orientation relative thereto.

Another object of the present invention resides in the provision of an arrangement for securing a lamphead to a panel utilizing a past to one end of which a lamphead swivel is connected, and wherein a keyway is formed in the lower or opposite end of the past consisting of a screw threaded stub shaft. The stub shaft is adapted to pass through a central lamp mounting hole in the panel until a nut formed at the upper end of the stub shaft rests on the panel forming a stop so as to prevent further axial movement of the stub shaft. The stub shaft also passes through a hole in a disk in which the disk located at the opposite side of the panel, and possesses a center hole of a diameter only slightly larger than the diameter of the stub shaft. A radially inwardly projecting key in the disk hole engages into the keyway so as to secure the stub shaft and disk from relative rotation. The disk includes a plurality of small apertures circumferentially spaced about the hole, adapted to have one or more apertures engage raised dimples formed on the surface of the plate opposite that contacted by the nut on the stub shaft, so that upon a screwthreaded lock nut being screwed onto the stub shaft, the apertures and dimples interengage, whereby the lamphead is secured in a predetermined selective rotational orientation relative to the plate or panel depending upon the rotational adjustment between the apertures and the dimples.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION OF A PREFERRED EMBODIMENT

Figure 1:
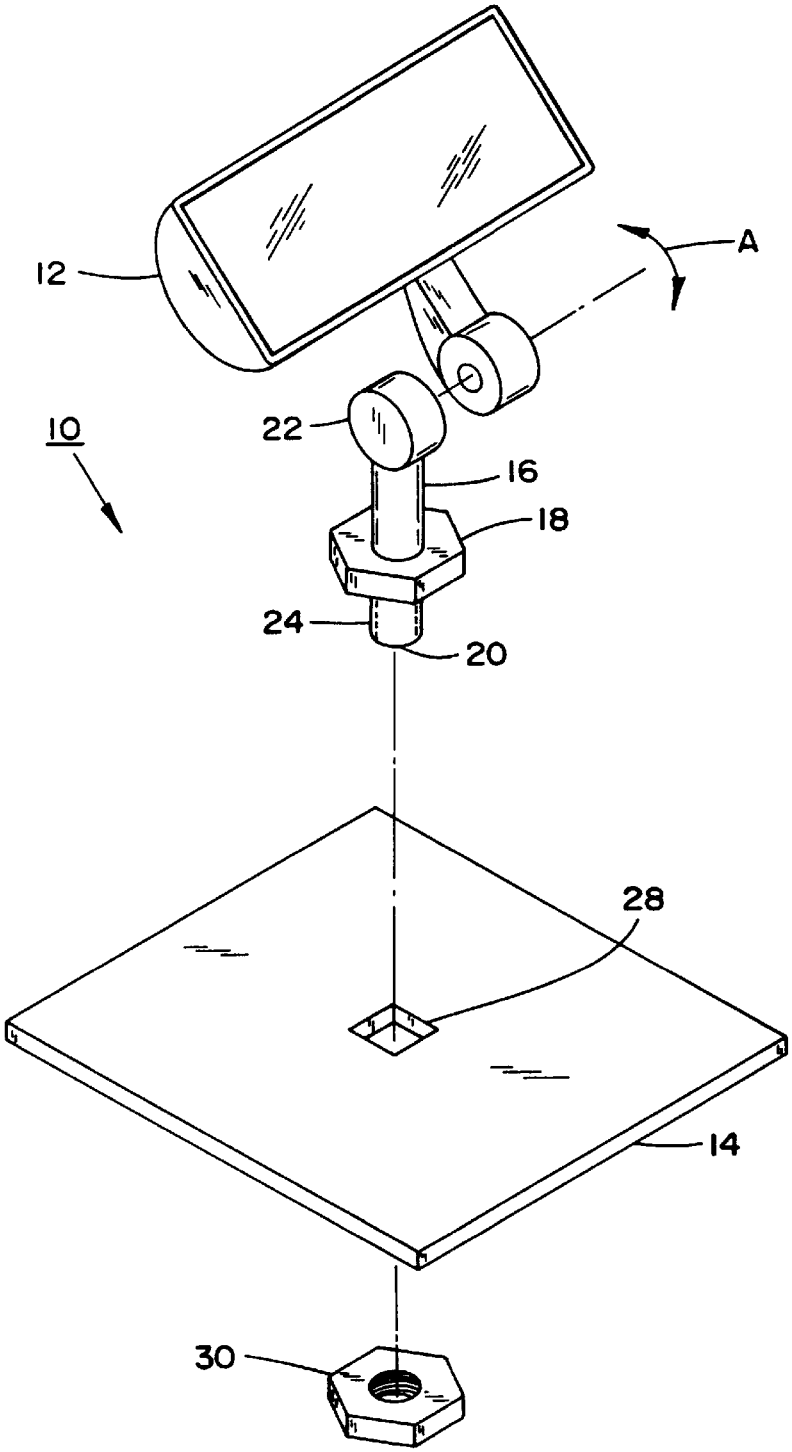
FIG. 1 (PRIOR ART)
FIG. 1 illustrates an exploded perspective view of an arrangement for securing a lamphead to a panel constructed pursuant to the prior art.

Referring now in particular to the construction of an arrangement 10 for securing a lamphead 12 to a panel 14 pursuant to the current state of the art, as shown in FIG. 1, the lamphead 12 is adapted to be fastened to a post 16, the lower portion of which includes an integral hexagonal nut 18 having a square (not shown) located therebelow from which there extends a stub shaft 20. The upper end of post 16 incorporates a swivel connection 22 which will permit the lamphead 12 to pivot along the direction of double-headed arrow A. The stub shaft 20 includes an external screw threaded portion 24, the upper end of which terminates at the square (not shown) located in fixed position below the hexagonal nut 18 which is integrally fastened to or connected with the stub shaft 20.

The panel 14, which may be a rectangular plate or any flat surface portion of a fixture for mounting lamphead 12, includes a square opening 28 through which the screw threaded portion 24 of stub shaft 20 is adapted to be passed, and wherein the size of the square opening is only slightly larger than the square below the hexagonal nut 18. Upon assembly, the square is seated in the square opening 28, thereby securing the lamphead 12 against rotational movement relative to the plate or panel 14.

Thereafter, a threaded lock nut 30 is screwed onto the screwthreaded stub shaft 20 so as to secure the entire assembly in a fixed position. In this particular instance, the lamphead 12 can only be rotated in increments of 90° degrees relative to the plate or fixture 14 by loosening the lock nut 30 and turning the square in the square hole or opening 28, which imparts only a limited versatility in the rotational adjustment of the lamphead relative to the panel.

Figure 2:
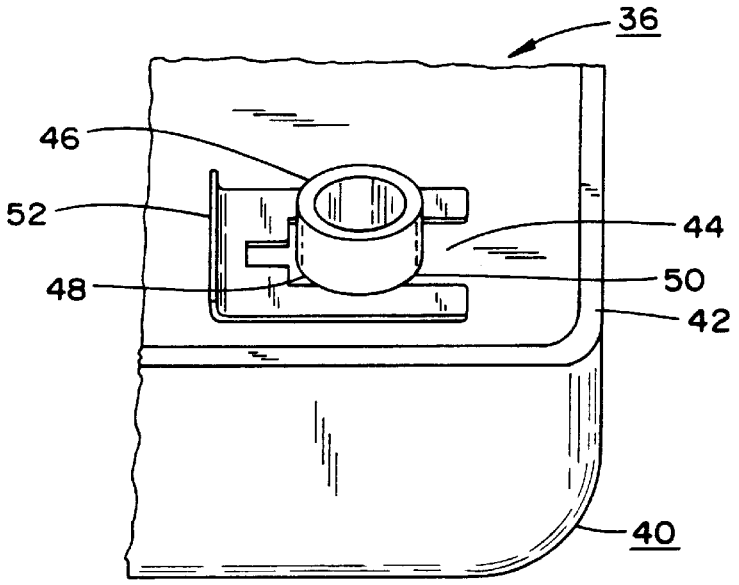
FIG.2 (PRIOR ART)
FIG. 2 illustrates a perspective bottom view of an attachment for securing a lamphead to a fixture in accordance with another embodiment pursuant to the prior art.
Figure 3:
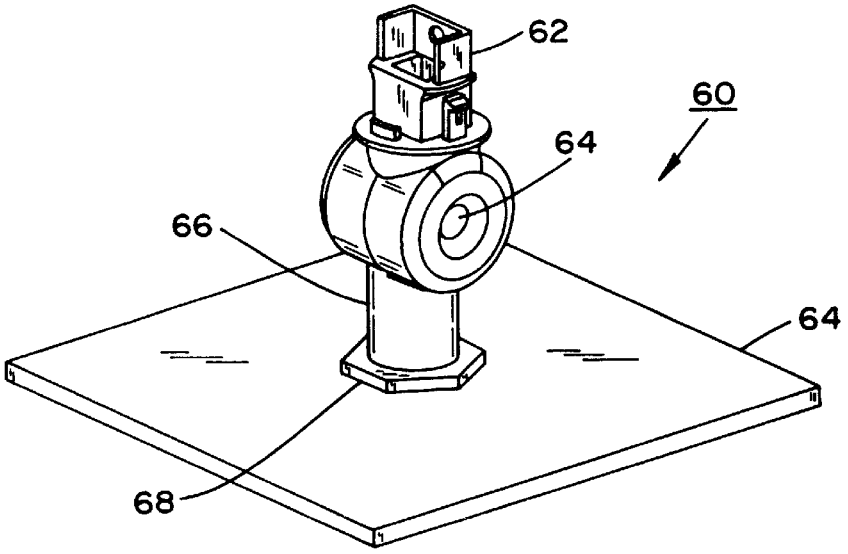
FIG. 3 illustrates a top perspective view of a typical lamphead swivel structure fastened to a panel.

With regard to another currently known arrangement 36 for securing a lamphead (not shown) to a panel or fixture, reference may be had to FIG. 2 of the drawings illustrating a fragmentary perspective bottom view of a fixture 40 having a peripheral upstanding wall structure 42 encompassing a flat surface 44 which, in essence, is in the form of a plate or panel structure. As shown in FIG. 2, a screw threaded stub shaft 46 extends through an opening 48 formed in the flat panel or surface 44 of the fixture 40, and includes an undercut or groove 50 which is engaged by a bifurcated clip element 52, which may be of spring steel or the like. Thereafter, if required, a threaded lock nut may be positioned over the clip element by being threaded onto the stub shaft so as to secure the entire arrangement. In this construction, it is at times difficult to maintain the clip element in its fixed position within the groove formed in the threaded stub shaft, rendering it difficult to maintain a precise rotational orientation of the lamphead relative to the fixture.

In order to improve upon the foregoing currently employed arrangements, the present invention, as shown in FIGS. 3 through 6 of the drawings, relates to a lamphead attachment arrangement 60, whereby a lamphead swivel unit 62 is adapted to mounted on a panel 64 which may be a surface component of a fixture or the like, and which is essentially of a plate-like construction, whereby the lamphead swivel unit 62 is adapted to be mounted thereon so as to be rotationally adjustable in a plurality of annularly closely indexed orientations.

Figure 4:
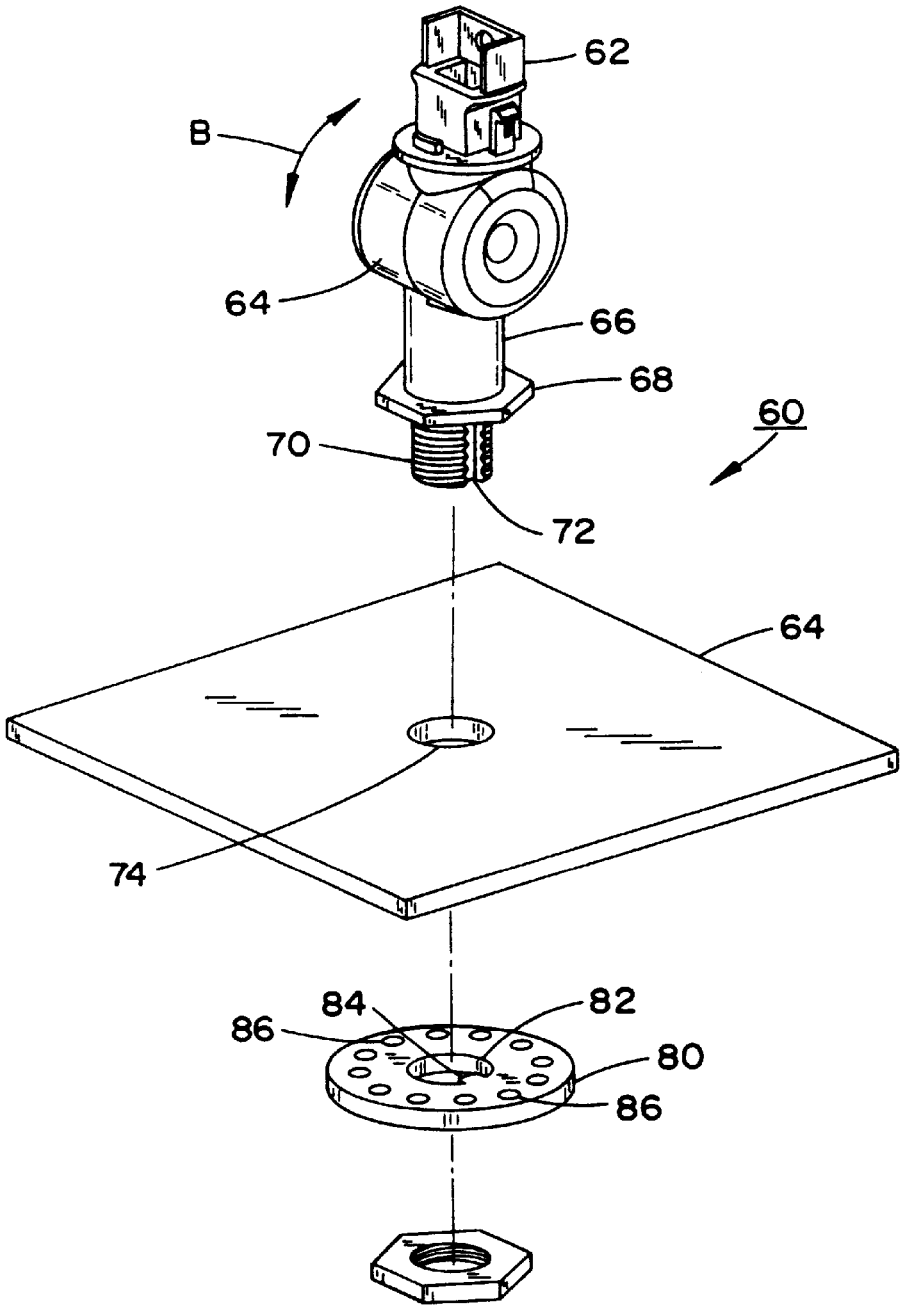
FIG. 4 illustrates, in an exploded perspective top plan view, the arrangement of FIG. 3 illustrating components for securing the lamphead to the panel in accordance with the present invention.

As shown particularly in the exploded view of FIG. 4 of the drawings, the lamphead swivel unit 62 includes an upper end having a swivel connection 64 for the pivotable attachment of a lamphead (not shown), which may be similar to lamphead 12 of FIG. 1, and depending from which there is a hollow post 66 of a construction to permit electrical wiring to extend therethrough, preferably of a cylindrical shape extending below the lamphead swivel connection 64, the latter of which may include an adjusting screw for the upward and downward pivoting orientation of the lamphead, as represented by double-headed arrow B.

The lower end of the cylindrical post portion 66 has a hexagonal nut 68 fixed thereto or integral therewith from which there then coaxially extends a stub shaft 70 having an external screw thread formed thereon. Formed in the screwthreaded surface of the stub shaft 70 is an axial slot or keyway 72, with the threaded stub shaft being adapted to extend through a central opening or hole 74 formed in the panel 64, the diameter of the hole being in a close but loose fit with the stub shaft.

A flat disk 80 which is adapted to be slid onto the threaded stub shaft 70 from the side of the panel 64 opposite the hexagonal nut 68 which contacts the opposite side of the panel, and includes a hole or central 82 opening which essentially has a diameter slightly larger than that of the stub shaft 70. The hole 82 of the disk 80 includes a key 84 extending radially inwardly, which engages into the keyway or slot 72 formed in the threaded stub shaft, upon the stub shaft 70 being passed through the disk 82. This, in essence will latch the disk 80 to the stub shaft 70 so as to inhibit relative rotation therebetween.

Figure 5:
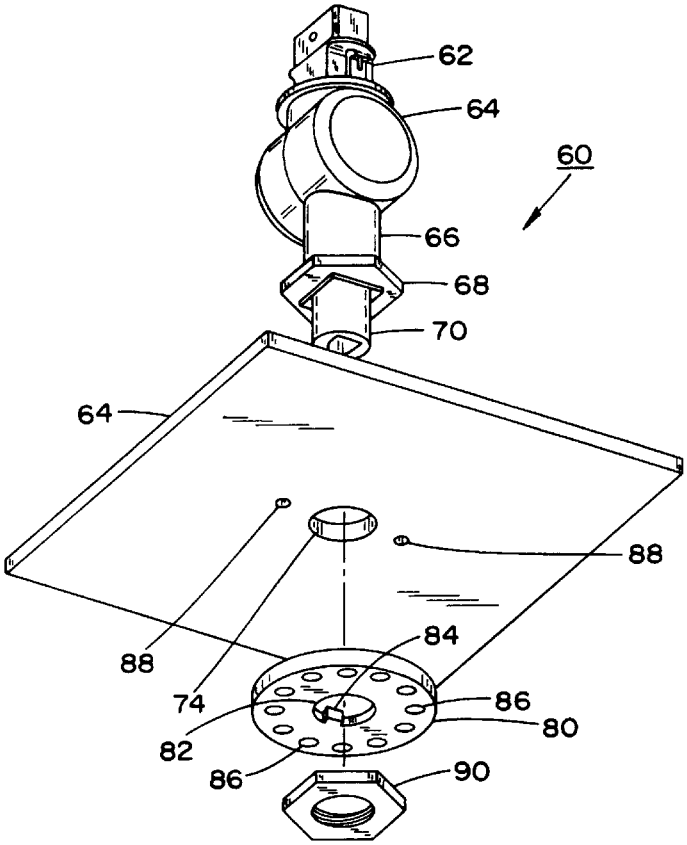
FIG. 5 illustrates an exploded bottom and front perspective view of the arrangement of FIG. 3.
Figure 6:
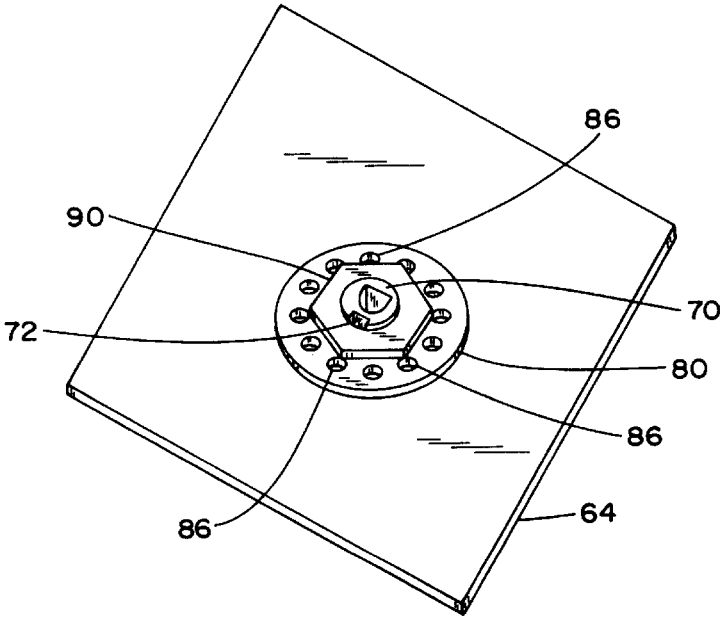
FIG. 6 illustrates a bottom perspective view of the arrangement for securing a lamphead to a panel, shown in the assembled condition thereof.

Extending in circular array about the central hole 82 in the disk 80 are a plurality of closely spaced small holes or apertures 86. The surface of the panel 64 facing the disk 80, as shown in FIG. 5, is equipped with one or more raised dimples 88 extending concentrically about the central opening 82, and being radially spaced relative thereto which is in correlation with the radius of the circular array of apertures 86 formed in the disk 80, so that when the arrangement is assembled the raised dimples 88 will engage into predetermined of the apertures 86 in the disk 80 which are located in alignment therebeneath. This will latch the disk 80 to the panel 64 and prevent any relative rotation therebetween. In order to lock the entire arrangement in its fixed position, a suitable threaded lock nut 90 engages the screwthreaded portion of the stub shaft 70 below the disk 80, as shown in FIG. 6, and is screwed tight, but allowing for rotation of the assembly, thereby locking the components of the assembly together. The rotation of the lamphead relative to the fixture or plate 64 is prevented due to the latching interengagement between the keyway 72 in the threaded stub shaft 70 and the key 84 in the hole 82 of the disk 80, and the latching engagement between one or more of the apertures 86 in the disk 80 with the raised dimples 88 formed in the surface of the panel. Inasmuch as a large quantity of apertures 86 are formed in the disk 80 in annularly closely spaced relationship, it is a simple procedure to rotationally index the lamphead post relative to the panel by merely enabling adjacent apertures in the disk to shift into engagement with the raised dimples in the facing surface of the panel, as may be desired. This enables the lamphead to assume a large variety of closely indexed rotational positions relative to the panel in the secure and precise orientation with the apertures 86 in the disk 80 interengaging with the raised dimples 88 formed in the panel 64.

The materials of the lock nut and the components formed by the disk 80 and the lamphead-supporting stub shaft 70 may be selected in a suitable manner from either plastics and/or metal which will impart a fixed or clamping engagement due to the natural interference between metal and plastic materials when the lock nut 90 is suitably tightened.

From the foregoing, it becomes readily apparent that the invention provides a versatile arrangement for the mounting of lampheads on panels, fixtures or the like so as to enable a considerable degree of adjustability to be obtained by the lamphead with a minimum of components and at relatively low and economically viable manufacturing and installation costs.

While there has been shown and described what is considered to be a preferred embodiment of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. An arrangement for attaching a lamphead to a panel; comprising:

(a) an elongate post member having means for mounting a lamphead at one end, an externally screwthreaded stub shaft extending from the opposite end of said post member, stop means being formed on said post member at the juncture with said stub shaft for contacting a first surface of said panel upon said stub shaft being passed through a hole in said panel;

(b) a disk member having a center hole being slidable onto said stub shaft from an opposite side of said panel; first cooperative engaging means on said disk member and stub shaft preventing relative rotation therebetween upon said stub shaft being passed through said center hole;

(c) lock nut means threadidly engaging said stub shaft so as to bias said disk member into contact with the opposite side of said panel;

(d) and second cooperative engaging means on said disk member and said opposite side of the panel for latching said disk member and said panel in one of a multiplicity of selective rotationally adjusted positions relative to each other upon securing of said lock nut means.

2. An arrangement as claimed in claim 1, wherein said first cooperative engaging means comprises an axial groove in the external screwthread of said stub shaft forming a keyway; and a radially inwardly extending key being formed in the center hole of said disk member extending into said keyway upon said disk member being slid onto said stub shaft, said keyway and said key being dimensioned to key said stub shaft and said disk member to each other preventing rotational movement therebetween.

3. An arrangement as claimed in claim 2, wherein the diameter of the center hole in said disk member is substantially in conformance with the diameter of said stub shaft.

4. An arrangement as claimed in claim 1, wherein said groove extends substantially the length of said stub shaft, and said key in the hole of said disk member is a rectangular tab element adapted to closely conform to said groove.

5. An arrangement as claimed in claim 1, wherein said post member and said stub shaft are integrally constructed, and said stop means comprises a hexagonal nut formation formed between said post member and said stub shaft.

6. An arrangement as claimed in claim 1, wherein a plurality of closely spaced apertures are formed in said disk member arranged circularly about said center hole; said panel having at least one raised dimple formed in the surface thereof facing said disk member and being at a radial distance so as to engage into respectively at least one of said apertures so as to cause said panel and disk member to be inhibited from rotational movement relative to each other and forming said second cooperative engaging means.

7. An arrangement as claimed in claim 6, wherein said panel and disk member, and resultingly said stub shaft including a lamphead mounted on said post member, are rotationally incrementally adjustable relative to each other depending upon the displacement between said at least one raised dimple and at least one of a multiplicity of said apertures in said disk member.

8. An arrangement as claimed in claim 1, wherein said means for mounting said lamphead on said post member comprises a swivel joint structure.

9. An arrangement as claimed in claim 1, wherein said post member comprises a hollow cylindrical element to facilitate the passage therethrough of electrical wiring.

10. An arrangement as claimed in claim 1, wherein at least some of the components of said arrangement are constituted of metal or plastic materials.

11. An arrangement as claimed in claim 1, wherein said panel comprises a plate portion of a fixture.

12. An arrangement for attaching a lamphead to a panel, said arrangement comprising: a post member having an attachment for said lamphead at one end thereof; a stub shaft having an external screwthread extending coaxially with said post member from an opposite end of said post member, said stub shaft being extendable through a hole formed in said panel; a nut member being formed on said post member at the juncture of said post member with said stub shaft so as to form a stop preventing the post member from passing into the hole of the panel; an axial keyway being formed in the external screwthread of said stub shaft; a disk having a central hole including a key structure extending radially into said hole, said disk being slidable onto said stub shaft from an opposite side of said plate so that said key engages into said keyway preventing relative rotation between said disk and said stub shaft; raised dimples being formed on said opposite side of the panel; a plurality of apertures formed in said disk and being spaced about said hole in said disk, at least one of said apertures being engaged by at least one said raised dimple whereby upon a lock nut being threaded onto said stub shaft into surface engagement with an opposite side of said disk said components are secured against relative rotation.

* * * * *